United States Patent [19]

Nutku

[11] 4,177,771

[45] Dec. 11, 1979

[54] ROTARY ENGINES WITH FREE RECIPROCATING-ROTATING PISTONS AND JET THRUST DRIVE

[76] Inventor: Ata Nutku, Dumen Sokak 5/1-D.12, Gumussuyu, Istanbul, Turkey

[21] Appl. No.: 760,692

[22] Filed: Jan. 19, 1977

[30] Foreign Application Priority Data

Aug. 12, 1976 [TR] Turkey ..... 72355

[51] Int. Cl.[2] ..... F02B 57/04

[52] U.S. Cl. ..... 123/43 C; 91/491; 123/23; 123/44 B

[58] Field of Search ..... 123/43 R, 43 C, 44 R, 123/44 C, 44 D, 44 E, 44 B, 23; 60/39.34; 91/491

[56] References Cited

U.S. PATENT DOCUMENTS

| | | | |
|---|---|---|---|
| 1,086,953 | 2/1914 | Tacchi | 123/44 EU X |
| 1,214,434 | 1/1917 | Cromp | 60/39.34 |
| 1,263,475 | 4/1918 | Shepard | 60/39.34 UX |
| 1,456,479 | 5/1923 | Atkinson | 123/43 C |
| 1,583,560 | 5/1926 | Morris | 123/44 D |
| 1,776,843 | 9/1930 | Schafer | 123/43 C |
| 2,689,534 | 9/1954 | Orshansky | 91/491 X |
| 2,707,461 | 5/1955 | Smith | 123/44 E |
| 3,161,183 | 12/1964 | Leath | 123/43 C |
| 3,270,723 | 9/1966 | Maroney | 123/43 R |
| 3,688,751 | 9/1972 | Sahagian | 123/44 E X |
| 3,841,279 | 10/1974 | Burns | 123/43 C |

FOREIGN PATENT DOCUMENTS

| | | | |
|---|---|---|---|
| 859694 | 12/1952 | Fed. Rep. of Germany | 123/43 R |
| 1099485 | 3/1955 | France | 60/39.34 |

*Primary Examiner*—Michael Koczo

*Attorney, Agent, or Firm*—Shapiro and Shapiro

[57] ABSTRACT

Rotary power engines driven by explosive or expansive media have pistons which reciprocate in cylinder cavities of a rotor at opposite sides of the rotor axis and which contact the walls of a stator by means of rollers. The rotor is turned by the reactive force of the pistons on the stator and by the reactive force of the working medium which exhausts from the cylinders as jets. In an internal combustion embodiment, one set of cylinders is used for compression of the working medium, and the compressed medium is transferred cyclically to adjoining cylinders for driving the rotor.

28 Claims, 7 Drawing Figures

ROTARY ENGINES WITH FREE RECIPROCATING-ROTATING PISTONS AND JET THRUST DRIVE

BACKGROUND OF THE INVENTION

This invention relates to improved rotary machines and is more particularly concerned with rotary engines having freely reciprocating pistons in rotors and which produce rotational torque by reactional forces on the pistons and additionally by jet thrust of exhaust from the rotor periphery.

In prior art machines producing their torque by reactional forces acting upon pistons in cylinders carried by a rotor, the rotor cylinders are deployed radially, and with multi-arched stator casings the piston strokes have to be short and working pressures very high. In general such machines are employed only for hydraulic machinery, their characteristics being undesirable for an expansive-medium engine application. Furthermore, with admission and exhausting of the medium being effected from the same port in a hub, the resulting flow regime is inappropriate for high efficiencies.

BRIEF DESCRIPTION OF THE INVENTION

It is a principal object of the invention to provide improved rotary-reciprocating piston machines, and particularly engines which produce rotational torque by reactional forces acting on the pistons from stator walls and additionally by the thrust of gases exhausted from rotor cylinders, uniflow of the working medium being maintained, and torque, overall efficiency and fuel economy being increased.

Another object of the invention is to provide increased and even torque in rotary engines by employing pairs of opposed rotor cylinder cavities with axes staggered at opposite sides of the rotor axis.

Another object of the invention is to provide improved engines employing tubular piston tail-rods eccentric to the piston axis to enable the jetting of exhausted medium through tail-rod ducts and also to prevent revolving of the pistons, thereby enabling the use of rollers on the piston tops and reducing the frictional loses between piston tops and the stator inner wall.

Another object of the invention is to attain more even torque by employing twin opposedly-arched stator casing walls in engines of the foregoing type.

Still another object of the invention is to provide a long-stroke, dynamically-balanced rotary piston engine by employment of twin laterally stepped stators with an eccentrically journalled rotor having groups of twin freely-reciprocating pistons in isolated cylinder cavities similarly fitted with tubular tail-rods having holes for discharging of exhausted medium to be jetted from rotor nozzles, thus increasing the duration of the stroke and increasing efficiency.

Yet another object of the invention is to provide an improved engine employing novel arrangements of inlet ducts and ports and exhaust slide-valves.

Still another object of the invention is to provide a novel rotary engine with cooperating sets of medium-compressing and power pistons.

It is also an object of the invention to provide a simple, rugged engine having the least amount of parts, which can be built and maintained at the least cost and yet can run on any expansive or explosive medium, including detonating charges or capsules, for which a charging-belt arrangement is provided.

BRIEF DESCRIPTION OF THE DRAWINGS

The invention will be further described in conjunction with the accompanying drawings, which illustrate preferred and exemplary embodiments of machines in accordance with the invention, similar parts being designated by similar reference numbers, appropriately primed in different embodiments, and wherein.

DETAILED DESCRIPTION OF THE INVENTION

Figure 2:
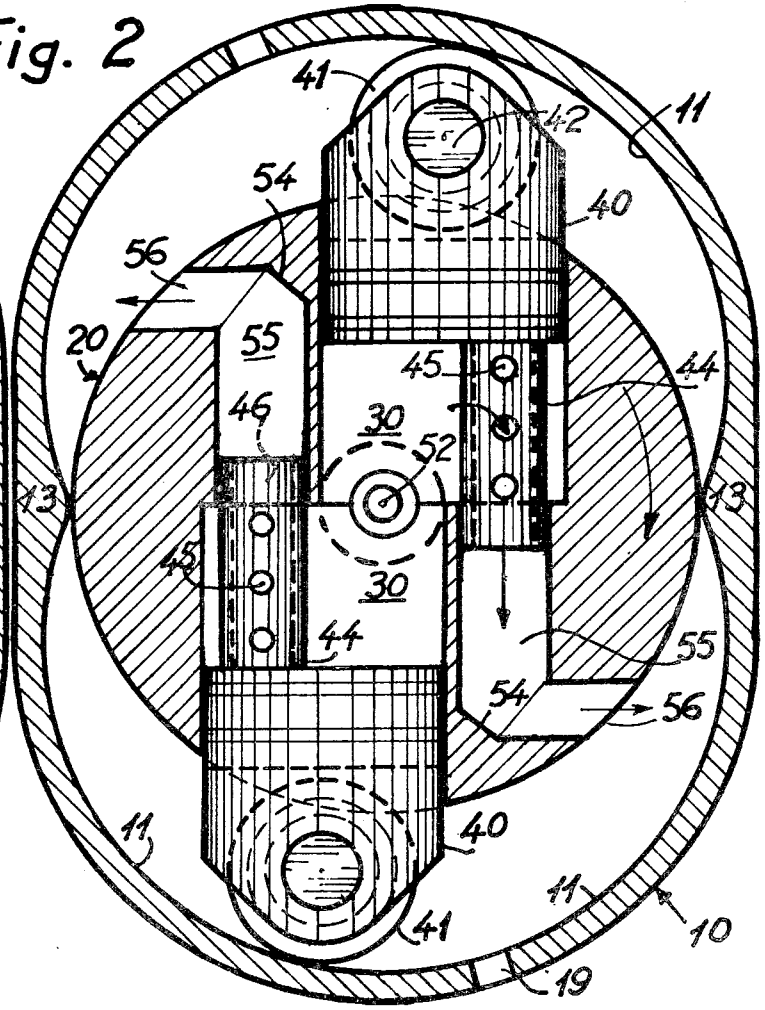
FIG. 2 is another transverse sectional view of the engine taken along line 2—2 of FIG. 3.
Figure 1:
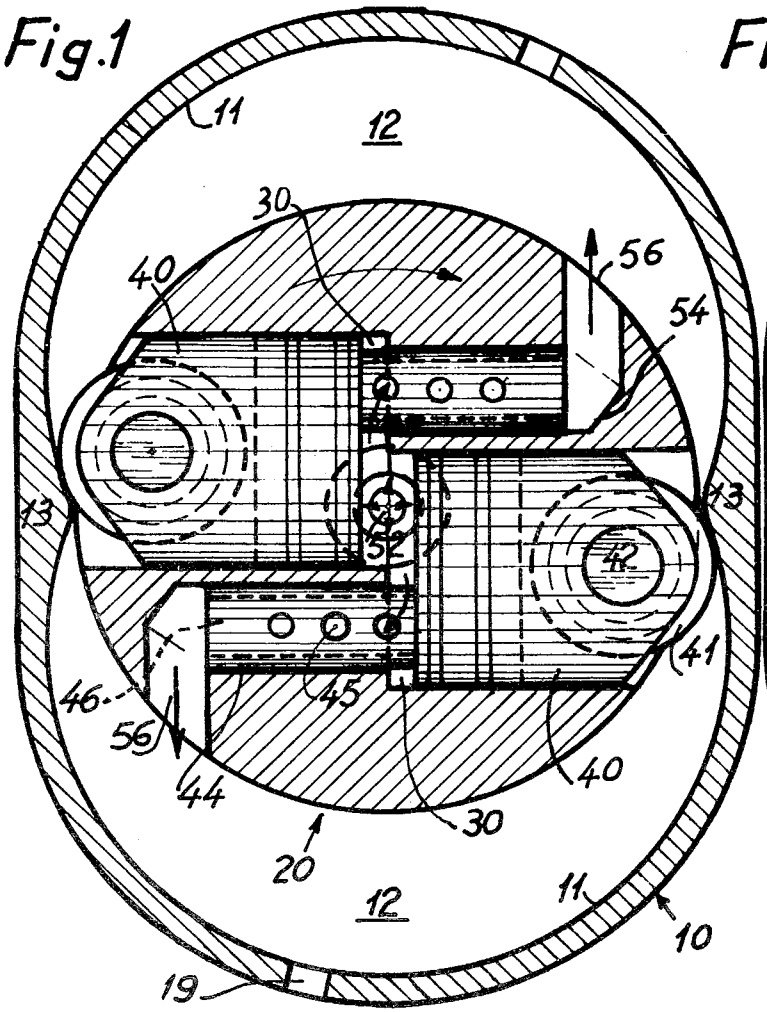
FIG. 1 is a transverse sectional view of a rotary engine in accordance with the invention taken along line 1—1 of FIG. 3.
Figure 3:
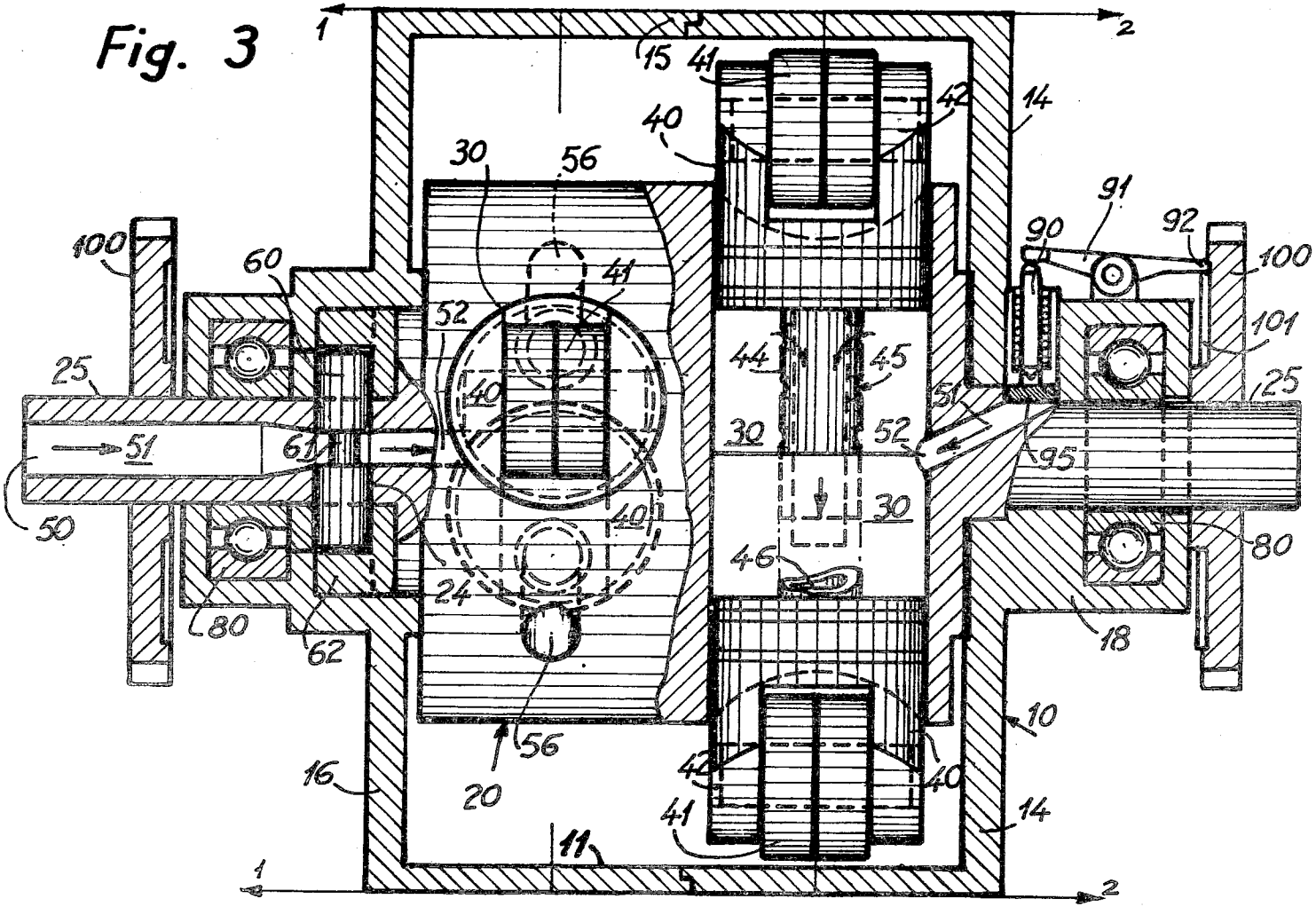
FIG. 3 is a longitudinal sectional view of the engine of FIGS. 1 and 2.

Referring to the drawings and initially to FIGS. 1, 2, and 3, a machine in accordance with the invention, such as an engine working with expansive media like steam, hot air or explosives, comprises a stator casing 10 having twin opposed cylindrical casing sections with arched inner walls 11 defining, with a cylindrical rotor 20, opposed crescent-shaped chambers 12 meeting at an axial plane of the engine containing the rotational axis of the rotor and producing dead points 13. The rotor axis is eccentric to each stator casing section. The stator also has end walls 14 and 16 with trunnions accommodating roller bearings 80 for opposite power shaft extensions 25 of the rotor.

The rotor has two sets of twin opposed cylindrical cavities 30, each set having connected cavities with axes staggered at opposite sides of the rotor axis. In the form shown, one set of cavities is displaced 90° from the other set about the axis of the rotor. In the cavities are provided freely reciprocating pistons 40 having tapered slotted heads fitted with rollers 41 by piston pins 42. The pistons also have piston tail-rods 44 eccentric to the piston and cavity axes and arranged in wells in the rotor, so as to guide and prevent rotation of the pistons. The tail-rods are hollow, having ducts 46 and holes 45 for the passage of the exhausted medium from the cylinders by means of ducts 55 and orifices 56 on the rotor periphery. The exhausted medium is jetted into the stator chambers 12 and out of the engine, or to a condenser, through outlets 19.

The left-hand side of FIG. 3 shows one arrangement for admitting an expansive working medium, the left rotor shaft 25 being provided with an opening 50 for admission of the fluid medium into adjacent cylinders through duct 51. A cylindrical slide valve 60 with a throat 61 mounted in hole 24 across rotor shaft 25 with its tips sliding or rolling inside an eccentric cam ring 62 is cyclically forced to reciprocate as the rotor turns, periodically leaving duct 51 open for the flow of the working medium into the associated cylinders 30. A similar arrangement may be provided for the right-hand side of the engine although a different arrangement is shown and will be described hereinafter.

In operation of the engine, the admitted expansive medium acting over the bottom of the pistons forces rollers 41 into steady rolling contact with stator inner walls 11, whereby the resultant reactional forces on the periphery of rollers 41 induce rotation of the rotor, while the expanding working fluid in the cylinders flowing through piston rod holes 45 and ducts 46 of tail-rods 44 is ejected into ducts 55, producing torque while acting on bends 54 and jetting out of orifices 56 to produce thrust to rotate the rotor 20. When the pistons have moved outwardly to the greatest extent, the reactional forces acting on piston rollers 41 by stator walls 11 force the pistons inward as the rotor turns, the jet thrust of the exhausted medium through orifices 56 increasing in intensity as the pistons compress the working medium on the return stroke and force the exhaust out of nozzle orifices 56.

For the operation of the machine by employment of detonating capsules, an arrangement as shown at the right-hand side of FIG. 3 may be employed. A spring-loaded needle 90 is mounted in stator trunnion 18 near end wall 14 and is actuated by a trigger mechanism having a lever 91 whose end 92 extends into grooved cam-track 101 at the inner face periphery of the flywheel or gear 100. The capsule-charges insertedly mounted on the charge belt 95 moving crosswise to the engine axis through a belt-slit in the stator trunnion meet cyclically with a port on the periphery of right shaft 25 when the needle strikes, and exploding gases issued by the detonation rush into the adjacent cylinders through duct 51 and orifice 52, forcing the pistons to move outwardly.

Irrespective of which inlet arrangement is used, rotation of the rotor is produced by the reactive force on the rollers and by the gases ejected through holes 45, ducts 46, ducts 55 and orifices 56 and into the stator chambers, which serve as exhaust manifolds for discharging the exhaust gases into open air or to a condenser through exhaust outlets 19 on the stator wall periphery as stated previously. The outward movement of the pistons is aided by centrifugal force.

Figure 4:
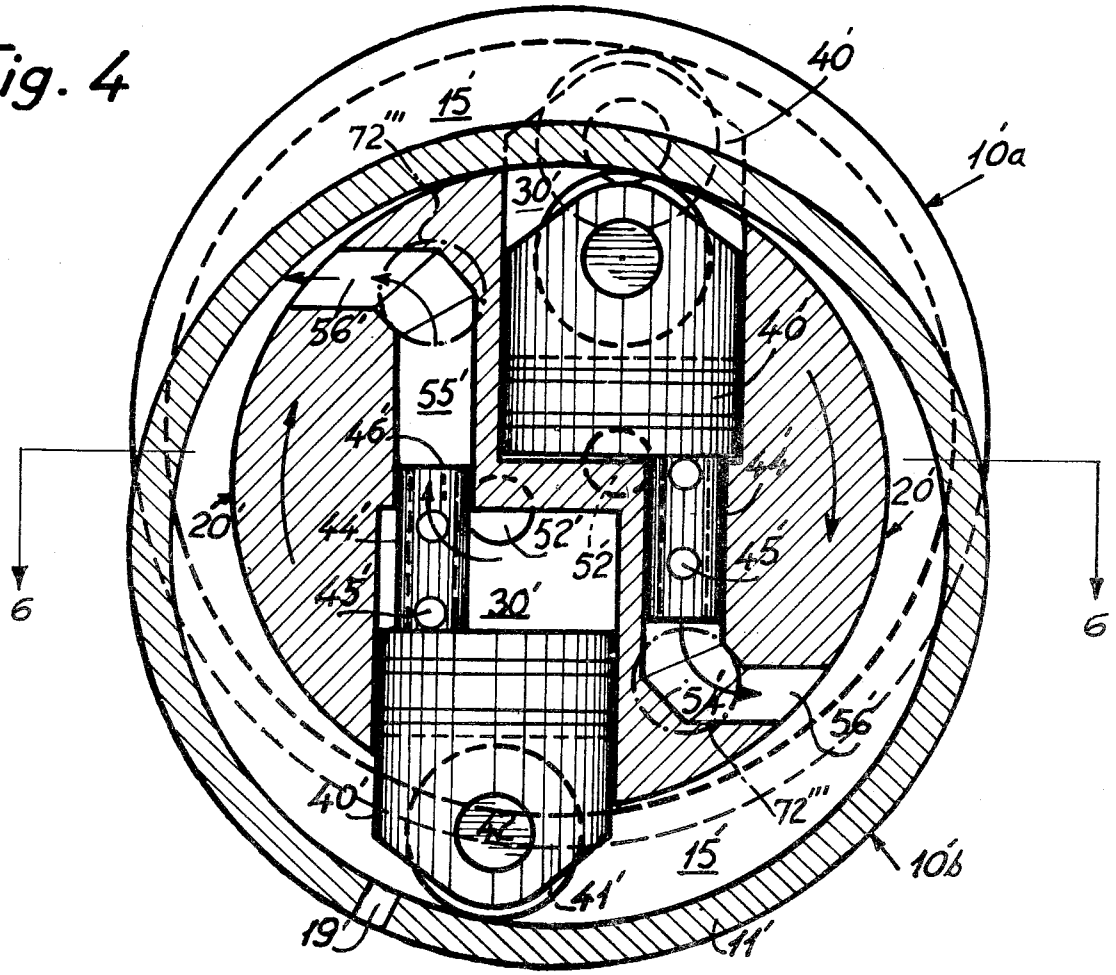
FIG. 4 is a transverse sectional view of another embodiment of the invention, taken along line 4—4 of FIG. 5.
Figure 5:
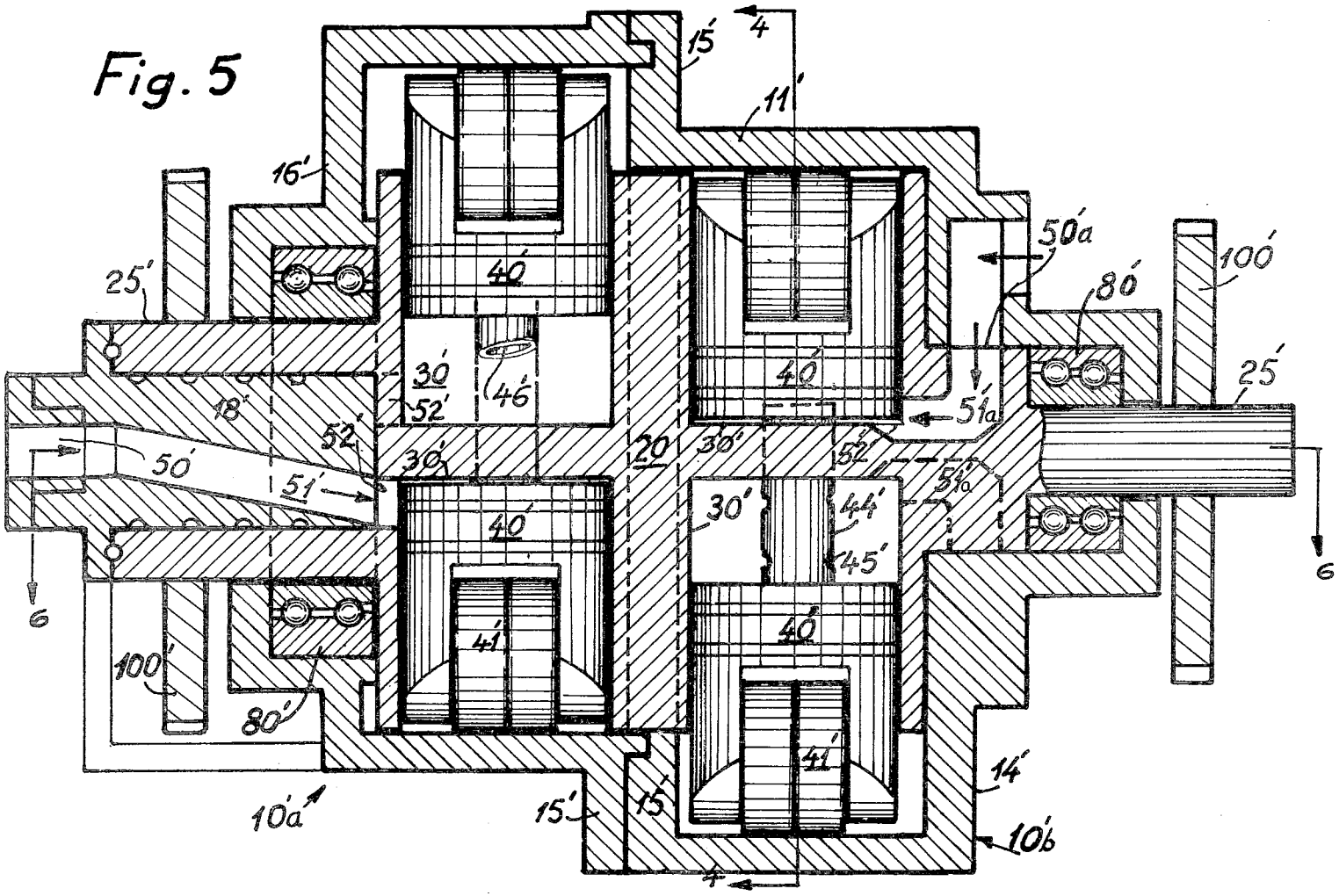
FIG. 5 is a longitudinal sectional view of the engine of FIG. 4.
Figure 6:
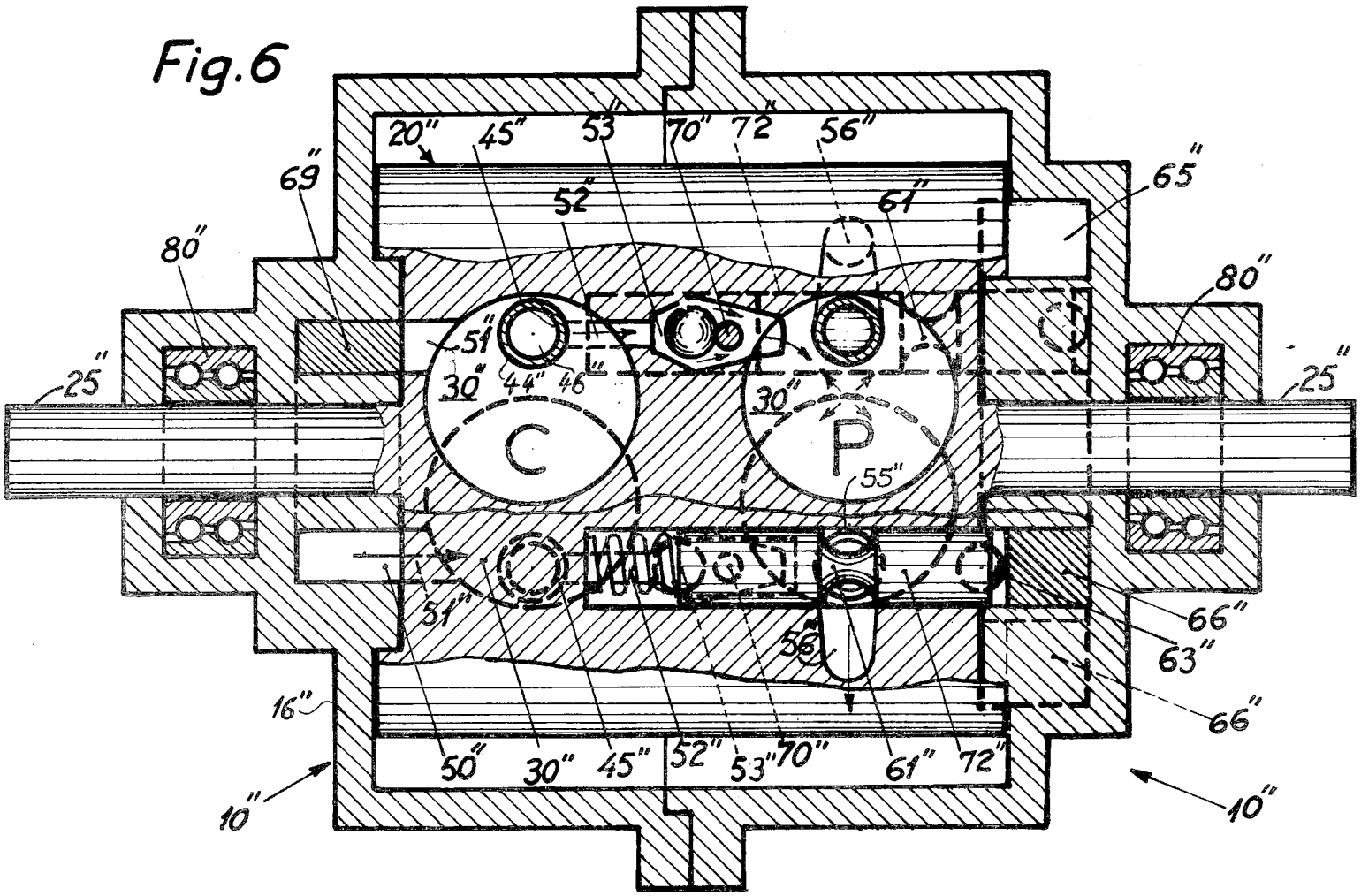
FIG. 6 is a horizontal sectional view taken generally along line 6—6 of FIG. 4, but showing structure particularly designed for an internal combustion embodiment.

In the engine shown in FIGS. 4, 5, and 6, the rotor 20' has sets of isolated opposed twin cylindrical cavities 30', the sets in this case having axes parallel to each other instead of displaced by 90° as in the previous embodiment. The stator is formed of two successive laterally-stepped cylindrical sections **10'*a* and 10'*b*, as shown in FIG. 5, joined by flanges 15'. The axes of the sections are parallel and at opposite sides of the rotor axis, so that the cylindrical rotor is oppositely eccentric in the stator casing sections, sweeping one section at one side and the other section at the opposite side. Thus when piston 40' of one set arrives at the bottom of its in-stroke the other piston of that set arrives at the top of its out-stroke, and vice versa for the pistons of the other set, producing acting force couples around the complete revolution of the rotor and balanced harmonic torque, as can be perceived from FIG. 4. In FIG. 5 two alternative types of arrangements for inlet ducts are shown. The left-hand side comprises a cylindrical hub body 18' stationary inside the drive shaft 25' and provided with an inclined duct 51' extending from inlet 50' to meet cyclically and alternately with ports 52' of the adjacent cylinder cavities as the rotor turns. The right-hand side comprises an inlet duct arrangement including an inlet duct 51'*a* for each adjacent cylinder cavity, which mates with an arcuate admission channel 50'*a*** for a portion of a revolution of the rotor. Any arrangement may be used at either side of either embodiment.

FIG. 6 shows an arrangement of ducts in an internal combustion embodiment of the invention, a pair of cylinders on the left serving as compressors (C) and a pair of cylinders on the right developing power (P). Admission of working fluid is performed when an inlet port 51'' of a cylinder at the left side meets cyclically with open part 50'' of an annular channel in stator wall 16'' rather than meeting with a blocking part 69''. The working medium after being compressed by a compression cylinder 30'', is ejected into duct 52'' through the inner duct 46'' and port 45'' on piston tail-rod 44''. Overpressure pushes check valve ball 53'' against a return spring to open duct 52'' for passage of the compressed medium into the corresponding power cylinder 30'' while a spark-plug or heating coil 70'' ignites it. Sliding exhaust control valves 72'' have throats 61'' which reciprocate across associated exhaust ducts 55'' and cyclically open or close them alternately. The exhaust valves are controlled from valve control channel 65'' by annular cam-wedge 66'' at one end against which balls 63'' are urged by springs at the other end. In FIG. 6 the shaded left cylinder 30'' is seen admitting working fluid, the unshaded left cylinder 30'' is shown at the end of compression, transferring the medium into the unshaded right cylinder 30'' starting the power stroke, and the shaded right cylinder 30'' is shown jetting the exhaust.

Figure 7:
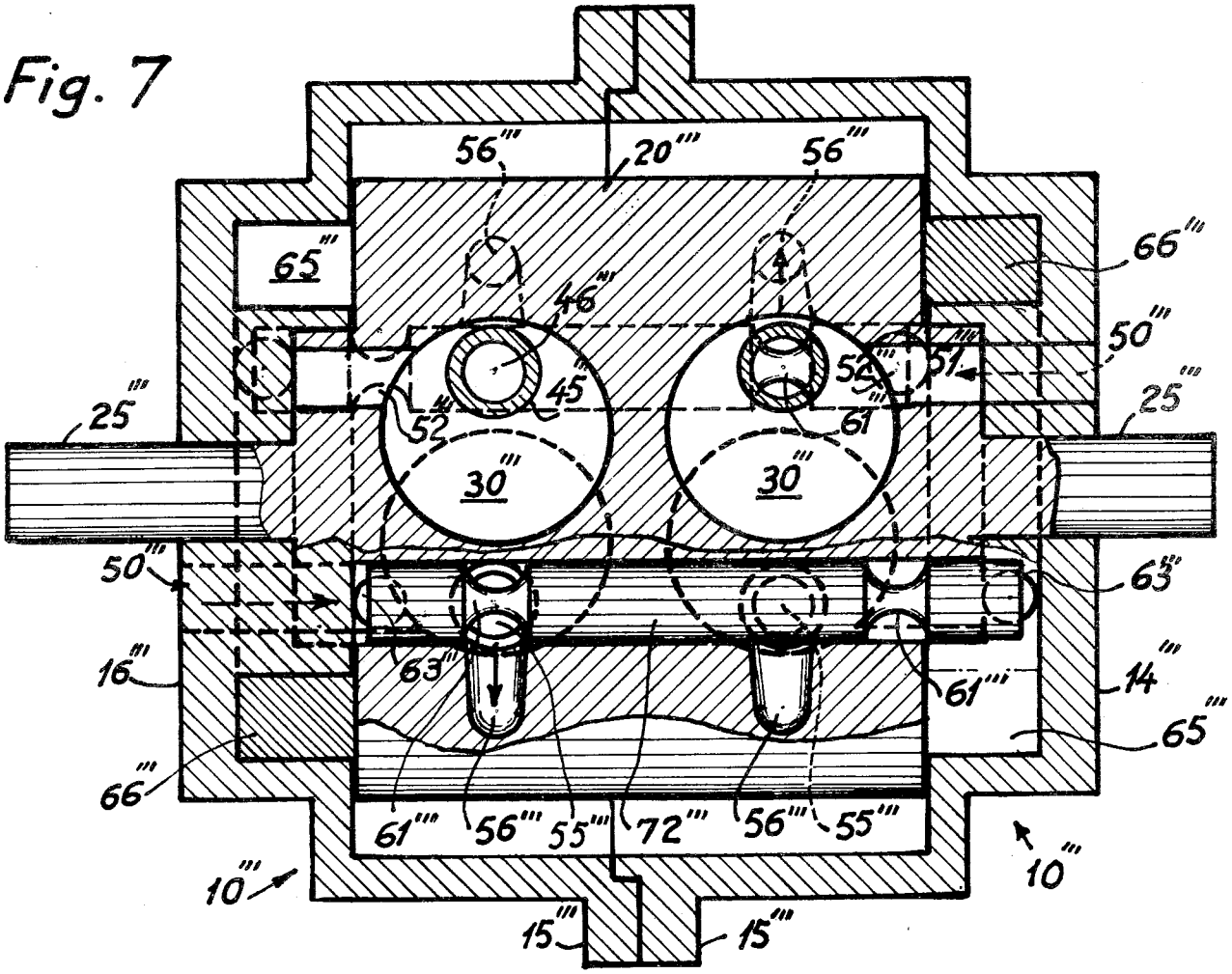
FIG. 7 is a horizontal sectional view, similar to FIG. 6, of a modified engine fitted with exhaust controlling slide-valves.

FIG. 7 shows a double-throated exhaust control valve system for an expansive-medium engine, such as the engine of FIG. 4, in which cylindrical slide-valves 72''' each having two throats 61''' are mounted along the rotor to reciprocate across associated pairs of exhaust ducts 55''' (as shown in phantom in FIG. 4). One valve is thrust to the right-hand control channel by a left-hand cam-wedge 66''', freeing the nozzle 56''' of a lefthand cylinder 30''' for jetting the exhaust into the stator, while the nozzle belonging to the corresponding right-hand cylinder is blocked. On the opposite side of the rotor the other slide valve 72''' is thrust to the left by right-hand cam-wedge 66''' into left-hand channel 65''', freeing the jetting nozzle of a right-hand cylinder and blocking the channel of the corresponding left-hand cylinder. The exhaust valves are moved to the left and right alternately. The cylinders may have their intake ducts opened and blocked alternately, as in FIG. 5, for example, as is conventional in expansive medium engines.

While preferred embodiments of the invention have been shown and described, it will be apparent to those skilled in the art that changes can be made in these embodiments without departing from the principles and spirit of the invention, the scope of which is defined in the appended claims.

The invention claimed is:

1. A rotary engine comprising a stator casing containing a rotor, said rotor having at least one cylinder cavity therein containing a reciprocating piston that has an outer end with means engaging a wall of said casing and that has an inner end provided with an eccentric tail-rod that reciprocates in a well and prevents rotation of the piston, the configuration of said casing and said rotor being correlated so that said piston moves in and out of said rotor as the rotor turns with said piston in contact with said casing wall, means for admitting a working fluid to said cylinder cavity for urging said piston out of said rotor, and means for exhausting said fluid from said cylinder cavity as a jet from the periphery of said rotor, whereby said rotor is driven by the exhausting of said fluid from said cylinder cavity and by the reactive forces of the casing wall upon said piston.

2. An engine in accordance with claim 1, wherein said casing has a pair of opposed crescent-shaped chambers therein and said rotor is substantially cylindrical with its axis of rotation substantially in the plane at which said chambers meet.

3. An engine in accordance with claim 2, wherein a surface of said rotor sweeps regions of the casing periphery where the chambers meet at opposite sides of the rotor.

4. An engine in accordance with claim 1, wherein said rotor has a pair of opposed cylinder cavities having axes staggered at opposite sides of the rotational axis of the rotor and each containing a piston with means engaging a wall of said casing and with an eccentric tail-rod.

5. An engine in accordance with claim 4, wherein said cylinder cavities are connected for communication at adjacent ends.

6. An engine in accordance with claim 5, wherein said tail-rods reciprocate in wells at opposite sides of the rotational axis of the rotor.

7. An engine in accordance with claim 6, wherein said tail-rods are hollow and connect the associated cylinder cavities for communication with rotor exhaust passages.

8. An engine in accordance with claim 7, wherein said exhaust passages have bends against which the exhausting fluid reacts.

9. An engine in accordance with claim 1, wherein said piston contacts the wall of the stator casing by means of a roller mounted on the piston.

10. An engine in accordance with claim 1, wherein said rotor has two pairs of opposed cylinder cavities, with the orientation of said pairs displaced from each other about the axis of rotation of said rotor.

11. An engine in accordance with claim 1, wherein said admitting means comprises an inlet passage controlled by an inlet valve.

12. An engine in accordance with claim 11, wherein said inlet valve comprises a cam-operated reciprocating valve member.

13. An engine in accordance with claim 1, wherein said admitting means comprises an inlet passage, and means for supplying successive exploding charges to said passage.

14. An engine in accordance with claim 13, wherein the last-mentioned means comprises a belt carrying a series of explosive charges, and means for firing said charges in succession.

15. An engine in accordance with claim 14, wherein said charges comprise explosive capsules and said firing means comprises a cam-driven firing element.

16. An engine in accordance with claim 15, wherein the charges are carried by said belt through a slit in a trunnion part of said stator casing so that successive charges are aligned with said inlet passage for firing.

17. An engine in accordance with claim 1, wherein said casing comprises a cylindrical section and said rotor rotates eccentrically in said section.

18. An engine in accordance with claim 17, wherein said casing comprises a second cylindrical section in which said rotor rotates eccentrically, said rotor having an axis of rotation parallel to the axes of said sections, said sections being arranged successively along the axis of rotation of the rotor and displaced laterally from each other, said rotor having a surface that sweeps different regions of the peripheries of said sections.

19. An engine in accordance with claim 17, wherein said casing comprises a second cylindrical section stepped laterally from the first-mentioned section, said sections having parallel axes at opposite sides of the rotor axis, there being at least one of said cylinder cavities in each section.

20. An engine in accordance with claim 19, wherein the axes of the cylinder cavities in the respective sections are substantially parallel.

21. An engine in accordance with claim 20, there being a pair of opposed cylinder cavities in each section, one piston of each pair moving outwardly while the other moves inwardly and corresponding pistons of said pairs reciprocating oppositely.

22. An engine in accordance with claim 21, wherein said cylinder cavities are isolated and said fluid is admitted and exhausted from said cylinder cavities individually.

23. An engine in accordance with claim 21, wherein one pair of pistons serves to compress said fluid and the other pair of pistons serves to power the rotor in response to fluid compressed by pistons of the first-mentioned pair.

24. An engine in accordance with claim 1, wherein said admitting means comprises a port of said cylinder cavity which mates periodically with a stationary inlet duct.

25. An engine in acccordance with claim 24, wherein said exhausting means comprises a separate exhaust duct leading from said cylinder cavity.

26. A rotary machine comprising a stator casing containing a rotor, said rotor having at least one cylinder cavity therein containing a reciprocating piston engaging a wall of said casing, the configuration of said casing and said rotor being correlated so that said piston moves in and out of said rotor as the rotor turns with said piston in contact with said casing wall, means for admitting a working fluid to said cylinder cavity, said cylinder cavity having a well extending from an end thereof interiorly of the rotor eccentric to the cylinder cavity axis, said piston having a tubular tail-rod extending from an end thereof interiorly of the rotor and movable in said well for guiding said piston and preventing rotation thereof, and means including a hole in said rod for exhausting said fluid from said cavity through said well.

27. A rotary machine in accordance with claim 26, wherein said rotor has a pair of opposed cylinder cavities with parallel axes at opposite sides of the axis of rotation of said rotor.

28. A rotary machine in accordance with claim 27, wherein the pistons of said cylinder cavities engage said casing wall by means of rollers mounted on said pistons.

* * * * *